US006439544B1

(12) United States Patent
Rosenberg

(10) Patent No.: US 6,439,544 B1
(45) Date of Patent: Aug. 27, 2002

(54) STAIR TOW SYSTEM AND METHOD

(76) Inventor: Conrad Rosenberg, 163 Green Pond Rd., Sherman, CT (US) 06784

( * ) Notice: Subject to any disclaimer, the term of this patent is extended or adjusted under 35 U.S.C. 154(b) by 0 days.

(21) Appl. No.: 09/766,516

(22) Filed: Jan. 19, 2001

(51) Int. Cl.[7] ..... B66D 1/36
(52) U.S. Cl. ..... 254/334; 254/338
(58) Field of Search ..... 254/264, 266, 254/267, 274, 276, 334, 338, 362, 393, 394

(56) References Cited

U.S. PATENT DOCUMENTS

| | | | | | |
|---|---|---|---|---|---|
| 2,368,039 | A | * | 1/1945 | Parker | 254/276 |
| 3,749,202 | A | * | 7/1973 | Puls | 254/276 |
| 3,913,763 | A | | 10/1975 | Lee | 214/505 |
| 3,997,070 | A | | 12/1976 | Lee | 214/152 |
| 4,026,526 | A | * | 5/1977 | Messerschmidt et al. | 254/264 |
| 4,174,023 | A | | 11/1979 | Dooley | 187/12 |
| 5,105,914 | A | | 4/1992 | Holden | 187/12 |
| 5,142,991 | A | | 9/1992 | Theis | 104/178 |
| 5,205,697 | A | | 4/1993 | Getty et al. | 414/341 |
| 5,522,581 | A | * | 6/1996 | Kulhavy | 254/267 |
| 5,553,548 | A | | 9/1996 | Eaton | 104/183 |
| 5,632,357 | A | | 5/1997 | Matre | 187/200 |
| 5,632,469 | A | * | 5/1997 | Heun et al. | 254/267 |
| 5,865,426 | A | * | 2/1999 | Kazerooni | 254/266 |
| 5,967,265 | A | | 10/1999 | Bruno et al. | 187/201 |
| 6,053,286 | A | | 4/2000 | Balmer | 187/201 |
| 6,082,496 | A | | 7/2000 | Bovis et al. | 187/201 |

* cited by examiner

*Primary Examiner*—Emmanuel M. Marcelo
(74) *Attorney, Agent, or Firm*—Ryndak & Suri

(57) ABSTRACT

A device and method to assist a person to walk up a flight of stairs is provided. The device includes a winch that is suitable for mounting at the top of the stairway having a winch cable of sufficient length to provide walking assistance along the length of stairway desired. A winch controller is attached to the winch cable that is adapted for grasping by the person to be assisted. The winch controller may include a switch operable by the hand of the user to selectively cause the winch to operate and provide assistance to the user.

18 Claims, 4 Drawing Sheets

STAIR TOW SYSTEM AND METHOD

FIELD OF THE INVENTION

The invention relates to a device and method for assisting a person in walking up a flight of stairs and in particular to a stair tow device and method.

BACKGROUND OF THE INVENTION

The task of climbing stairs can be often a difficult undertaking for some people. For example, some people fully capable of walking unassisted on level surfaces acquire shortness of breath or experience weakness while climbing stairs. This may be due to advancement in years, recovery from illness or injury, heart or respiratory disease, neurological disease or limb or joint dysfunction.

Elevators have been used to carry disabled persons up or down a flight of stairs. The cost, installation, operation and maintenance of such devices, particularly for a home, however, is unduly excessive for those who are fully capable of walking on level surfaces but simply require some assistance when climbing stairs. A need therefore exists for an effective device for assisting such a person in walking up a flight of stairs.

SUMMARY OF THE INVENTION

In accordance with the present invention, a stair tow comprising a winch, a length of winch cable and a winch controller having a handgrip provides a convenient device for assisting a person when climbing a flight of stairs. Both the winch and the winch controller are attached to the winch cable. The winch controller is operatively connected to the winch and enables the user to selectively operate the winch. Thus, a person grasping the handgrip and operating the winch with the winch controller is thereby assisted in walking up a flight of stairs.

In one embodiment of the present invention, the winch controller is operatively connected to the winch by a suitable connection, such as by an electrical conductor extending from the winch controller to the winch, such as a wire which can be the winch cable or another wire that may be associated with the winch cable.

In one embodiment of the present invention, the winch is operatively connected to the winch controller by a radiofrequency communication device.

A suitable switch is part of the winch controller to turn the winch on and off and in one embodiment may be a button switch located on the handgrip for operation by a thumb or finger of the hand that grips the handgrip.

In accordance with another aspect of the present invention, a rotation sensor stops the operation of the winch if the winch fails to rotate for a predetermined length of time after activation.

In accordance with another aspect of the present invention, a cable distance sensor stops the operation of the winch if the winch controller comes within a predetermined distance of the winch.

Typically, the winch provides a suitable force to provide the desired stair climbing assistance, typically in the range of from about 30 pounds to about 300 pounds or more.

In accordance with another aspect of the present invention, a stair tow comprising a winch, a length of cable and a winch controller having a winch mounted at the top of a stairway provides a convenient device for assisting a person when climbing a flight of stairs. Both the winch and the winch controller are attached to the cable. The winch controller is operatively connected to the winch and causes the winch to operate. A person grasping the handgrip and operating the winch with the winch controller is thereby assisted in walking up a flight of stairs.

In an alternate embodiment of the present invention, a guide channel is mounted on the stairway wall when the stair tow device is used in conjunction with a non-linear stairway. Alternatively, a pulley or system of pulleys and/or cable guides may be utilized to run the cable from the winch to a location along the portion of the stairway where assistance will be provided.

In accordance with another aspect of the invention, a method for assisting a person in walking up a stairway is provided. The method is practiced with a device including a winch mounted at the top of the stairway or top portion of the stairway along which assistance is to be provided, a length of cable that is at least substantially as long as the length of the stairway along which walking assistance is to be provided, the cable having opposing ends, one cable end attached to said winch; and a winch controller handgrip attached to the other cable end, said winch controller handgrip operatively connected to the winch for selectively causing the winch to operate. The person who will be assisted by the device, while located towards the bottom of the length of the stairway over which assistance is to be provided, grasps the winch controller handgrip and actuates the winch through the winch controller handgrip to provide a force in the upward direction of the stairway while continuing to grasp the winch controller handgrip. Then, the person walks up the stairs while continuing to grasp the winch controller handgrip and is assisted by a pulling force in the upward direction of the stairway exerted on the winch controller handgrip by operation of the winch on the cable connected to the winch controller.

DETAILED DESCRIPTION OF THE PREFERRED EMBODIMENTS

Figure 1:
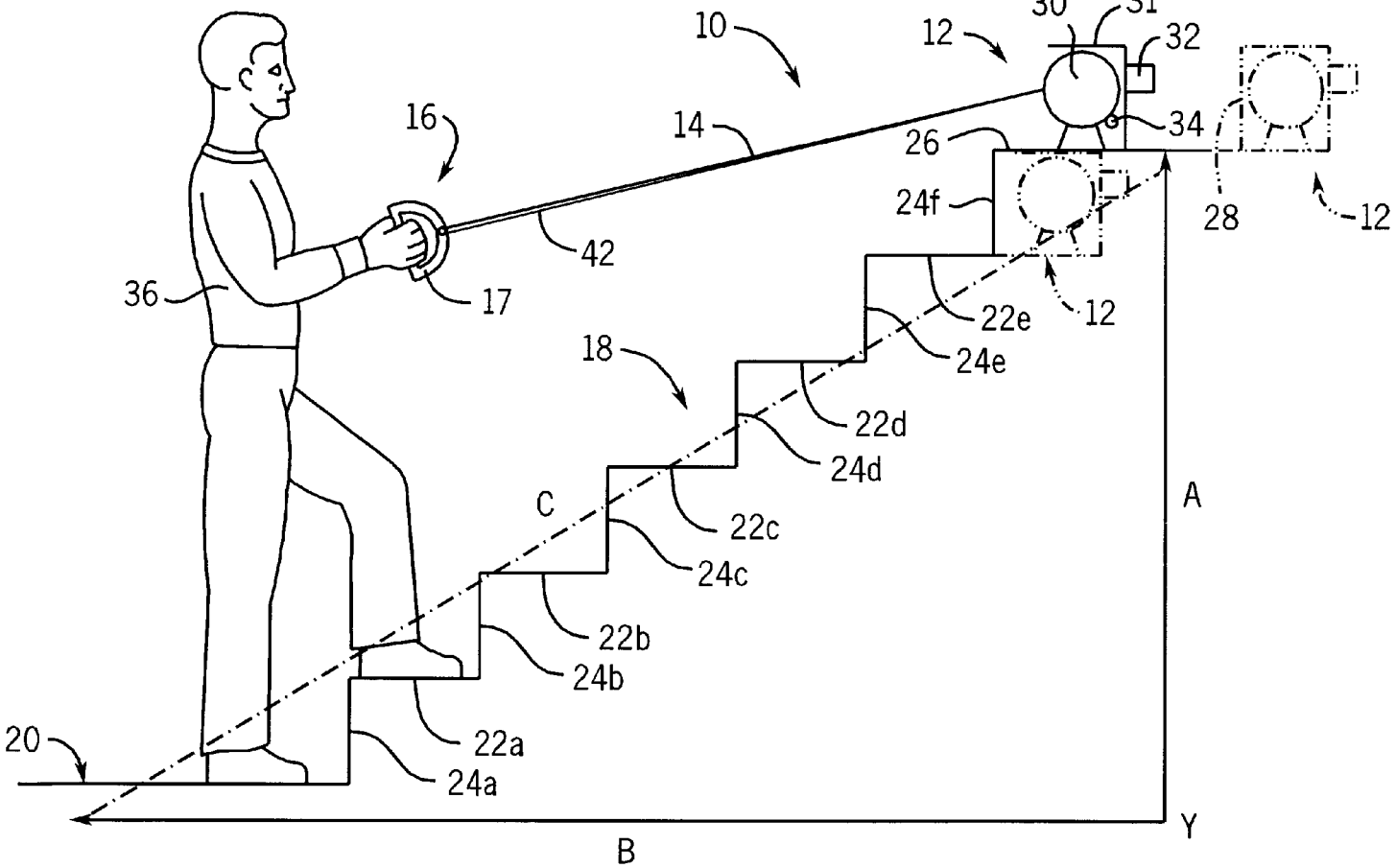
FIG. 1 is a perspective view of the stair tow device of the present invention.

Referring to the Figures generally, where like reference numerals denote like structure and elements, and in particular to FIG. 1 wherein a stair tow device 10 for assisting a person in walking up a flight of stairs or portion thereof is depicted in accordance with the present invention. Device 10 includes a winch 12 a winch cable 14 and a winch controller 16 having a handgrip 17. It is to be understood that stair tow 10 is to be used in conjunction with a stairway 18 having bottom landing 20, a plurality of horizontal treads 22, a plurality of vertical risers 24 and a top landing 26.

Winch 12 comprises winch drum 30, winch housing 31, winch control 32 and winch drive 34. Such devices are well known in the art. Consequently, the construction of winch 12 is not described in detail. Winch control 32 may have a microprocessor or other control device suitably adapted to control winch drive 34. Winch drive 34 rotates winch drum 30 according to winch control 32 input. Winch 12 produces suitable lifting force to provide the desired assistance. Preferably, this lifting force is in the range of about 30 to 300 pounds or more. Winch 12 is suitably adapted to be mounted at the top of stairway 18. It is to be understood that the winch could be mounted elsewhere, even at the bottom of the stairway or the portion, along which assistance Is to be provided as long as a portion of the winch cable can be pulled upward along the portion of the stairway along which assistance is to be provided. For example, the winch could be mounted at the stairway bottom (not shown) with a pulley system to direct the winch cable up the stairway and back down to the user. The claim language suitable for mounting at the top of a stairway or mounted at the top of the stairway is intended to include such an arrangement. Winch 12 may be mounted on top landing 26 flush with the top vertical riser 24*f*. Preferably, winch 12 is mounted away from stairway 18 on top landing 26 to allow unencumbered egress to and from the top of stairway 18. Winch 12 may be custom-installed to be recess mounted behind top riser 24*f*, or winch 12 can be custom-installed to be recess mounted behind top landing wall 28, as shown in phantom in FIG. 1.

Winch cable 14 has opposing ends with one end attached to winch drum 30. Any suitable means to secure winch cable 14 to winch drum 30 can be used as commonly known to those skilled in the art. Typically, winch drum 30 will have a hook or other fastener to secure an end of winch cable 14 to winch drum 30. Winch cable 14 may be made of any material having adequate tensile capacity to accommodate the lift force by winch 12. Such a material may include, but is not limited to, metal, rope, or a polymer such as plastic or nylon.

Typically, winch cable 14 is at least substantially as long as the length of staircase 18 or longer, as desired. The length of staircase 18 is the length of the hypotenuse C of the right triangle formed by the overall rise A of staircase 18 and overall run B of staircase 18 as shown in FIG. 1. It is recognized that a person using stair tow 10 may need assistance in walking up only a portion of stairway 18. Hence, the length of winch cable 14 can be adjusted to extend through only the portion of stairway 18 in which the person 36 requires assistance.

Figure 3:
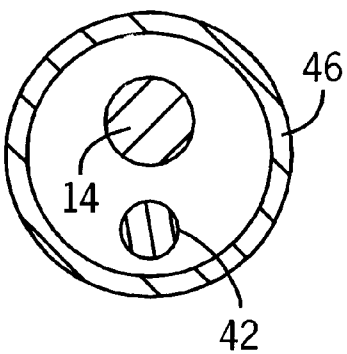
FIG. 3 is a cross sectional view of a preferred embodiment of the cable and control wire of FIG. 1.

The other end of winch cable 14 is attached to winch controller 16. Winch controller 16 is operatively connected to winch control 32 for causing winch 12 to operate. Preferably, winch controller 16 is operatively connected to the winch motor or prime mover or optionally to a winch control 32 to provide other control features by a control wire 42. One end of control wire 42 is attached to winch controller 16. The length of control wire 42 is substantially similar to and extends substantially parallel with winch cable 14. The other end of control wire 42 is attached to winch motor or winch control 32, for example. Control wire 42 is made of any suitable material with the resiliency to withstand constant winding around winch drum 30. Such material may include, but is not limited to, metal or fiberoptics. Preferably, winch cable 14 and control wire 42 are encased in sheath 46 as shown in FIG. 3. Sheath 46 may be made of plastic or rubber or any suitable nonconductive material. Alternatively, winch controller 16 and winch control 32 may operatively interact via radiofrequency communication. In this embodiment, winch controller 16 further comprises a transmitter and winch control 32 further comprises a radio receiver. The transmitter of winch controller 16 transmits radio signals to the radio receiver of winch control 32 thereby operating winch 12.

Winch drive 34 drives winch drum 30 according to operating options that can be selected by a user interfacing through winch control 32 or winch controller 16. Winch 12 may be powered by AC or DC power. As such, winch control 32 allows a user to select the appropriate power supply mode. Since the present invention is directed to assist a person in walking up stairs, it may be advantageous for stair tow 10 to be versatile to accommodate varying needs for different users. For example, the weight of each user in addition to the amount of assistance each user requires to walk up the stairs may vary greatly from user to user. Recognizing this, winch 12 can provide a suitable amount of force, as desired. Optionally, a winch control 32 provides a selector to adjust the pounds of force provided by winch drive 34. Typically, winch drive 34 drives winch drum 30 to provide a minimum of 500 pounds of force.

The user can also select from three operating modes for winch 12 through winch control 32. Winch 12 has three operating modes (although this is not necessary and any suitable winch can be used in accordance with the invention): retract, neutral and reverse. In retract mode, winch drum 30 rotates to wind winch cable 14 around winch drum 30. Neutral mode disengages winch drive 34 from winch drum 30. In reverse mode, winch drive 34 rotates winch drum 30 so that winch cable 14 unwinds from winch drum 30. In retract mode, winch 12 supplies a lifting force to winch cable 14 and winch controller 16. The winch may have a retract and reverse mode with no free spooling.

Figure 2:
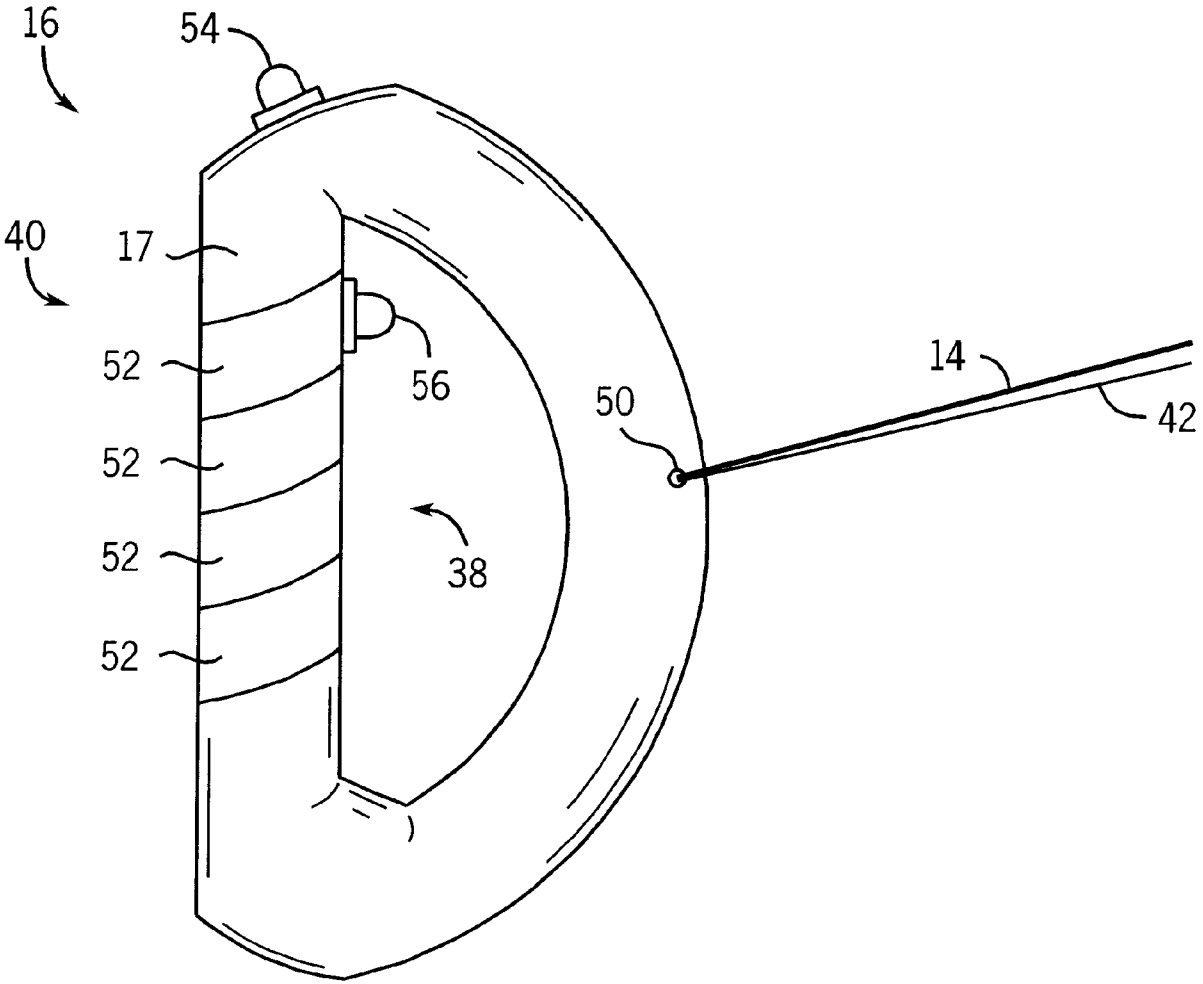
FIG. 2 is a perspective view of the winch controller of FIG. 1.

Winch controller 16 includes a body or body portion preferably in the form of a handgrip 17, which is suitably adapted to be gripped by a person 36 as shown in FIGS. 1 and 2 and preferably is in a shape that is conducive to grasping firmly by the hand of a person. As illustrated, handgrip 17 has inner grip region 38 and outer grip region 40. Handgrip 17 can be made of any material suitable to withstand the force exerted upon handgrip 17 when winch cable 14 is being pulled by winch 12. Such material may include, but is not limited to, metal, wood, rubber, or plastic. Moreover, handgrip 17 is structurally adapted to assist pulling or towing person 36 up staircase 18 when winch controller 16 activates the operation of winch 12. For example, winch cable 14 is centrally secured to handgrip 17. Typically, person 36 grips winch controller 16 in a manner so that handgrip 17 is between the shoulders and hips of person 36 and that person 36 walks up staircase 18 in a forward motion. By centrally securing winch cable 14 to handgrip 17, only minimal effort need be exerted by person 36 to maintain balance and equilibrium while being assisted up staircase 18 by stair tow 10. Handling winch controller 16 in this manner applies the lift force resulting from the operation of winch 12 generally about the lateral center of gravity of person 36. Preferably, winch controller 16 is operated by one hand leaving the other hand of person 36 free to use the stairway handrail for additional stability or for balance.

Winch cable 14 is secured to handgrip 17 by fastening winch cable 14 through central loophole or ring 50 as shown in FIG. 2. Preferably, handgrip 17 is ergonomically adapted to accommodate firm gripping by person 36 by further comprising finger contours 52. In an alternate embodiment of the present invention, handgrip 17 further comprises thumb button switch 54 located on outer grip region 40.

Thumb button switch 54 is spring-biased and activates the operation of winch 12 only when it is pressed by a thumb. Thumb button switch 54 thereby performs two functions. First, thumb button switch 54 controls the operation of winch 12 when pressed by person 36. Second, thumb button switch 54 provides a safety feature such that if thumb button switch 54 is not pressed, or if for any reason person cannot exercise control of the winch, winch 12 does not operate. This also allows for instant cessation of the lifting force by winch 12 in the event that person 36 requires a rest during the ascent of staircase 18. Also, if person 36 inadvertently drops winch controller 16 during the walk up staircase 18, winch 12 will stop operating. Hence, person 36 can readily relocate winch controller 16 and resume walking up staircase 18. This ensures that person 36 will not be stranded midway up staircase 18 without any assistance.

In an alternate embodiment of the present invention, thumb button switch 54 can be replaced with finger button switch 56 located on inner grip region 38 of handgrip 17 as shown in phantom in FIG. 2 or another suitably located switch as desired. The operation of finger button switch 56 is identical to the operation of thumb button switch 54. The only difference is that finger button switch 56 is actuated by the pressing force of a finger rather than by a pressing force from a thumb. It is to be understood that any finger can actuate finger button switch 56. Correspondingly, finger button switch 56 can be located anywhere on inner grip region 38. Finger button switch 56 may also extend substantially the entire length of inner grip region 38. Alternatively, handgrip 17 can comprise both controller 16 activates winch 12 only when both thumb button switch 54 and finger button switch 56 are pressed.

Winch 12 may have either or both of two configurations to permit unspooling of winch cable 14. For example, when person 36 is at top landing 26 and is prepared to descend staircase 18, person 36 selects either operation mode reverse or operation mode neutral on winch controller 16. When person 36 selects operation mode neutral, winch drive 34 disengages from winch drum 30 allowing winch cable 14 to freely spool from winch drum 30 enabling person 36 to carry winch controller 16 and pull winch cable 14 down staircase 18 to bottom landing 20. Selecting operation mode reverse, winch 12 rotates in a reverse direction to unwind winch cable 14 from winch drum 30. Person 36 can then walk down staircase 18 while operating the extension of winch cable 14 with winch controller 16. Once winch controller 16 is at bottom landing 20, it is stowed on hook 44 thereby clearing the stairway for use by others. When person 36 is prepared to walk up staircase 18, person 36 selects operation mode retract on winch controller 16 and walks up staircase 18 assisted by stair tow 10 as previously described.

Stair tow device 10 may include several safety features. A cable sensor in winch control 32 may be provided to monitor the amount of cable wound onto winch drum 30. When winch controller 16 comes within a predetermined distance to winch 12, the cable sensor stops the retracting operation of winch 12. This ensures winch controller 16 is not damaged by winch 12. Preferably, the predetermined distance is between about one to about two feet. Additionally, a rotation sensor in winch control 32 may be provided that determines whether winch 12 is in either operation mode retract or operation mode extend. If winch 12 is in either of these two modes and the rotation sensor senses that winch drum 30 has not rotated for a predetermined amount of time, the rotation sensor stops the operation of winch 12. Preferably, this predetermined amount of time is between about one second to about three seconds or otherwise as desired. This ensures that person 36 is not harmed if either person 36, winch cable 14 or winch controller 16 is obstructed during the walk up stairway 18. Winch controller 16 may further include a child protection device by requiring a key or a numeric password in order to operate stair tow 10.

Figure 4:
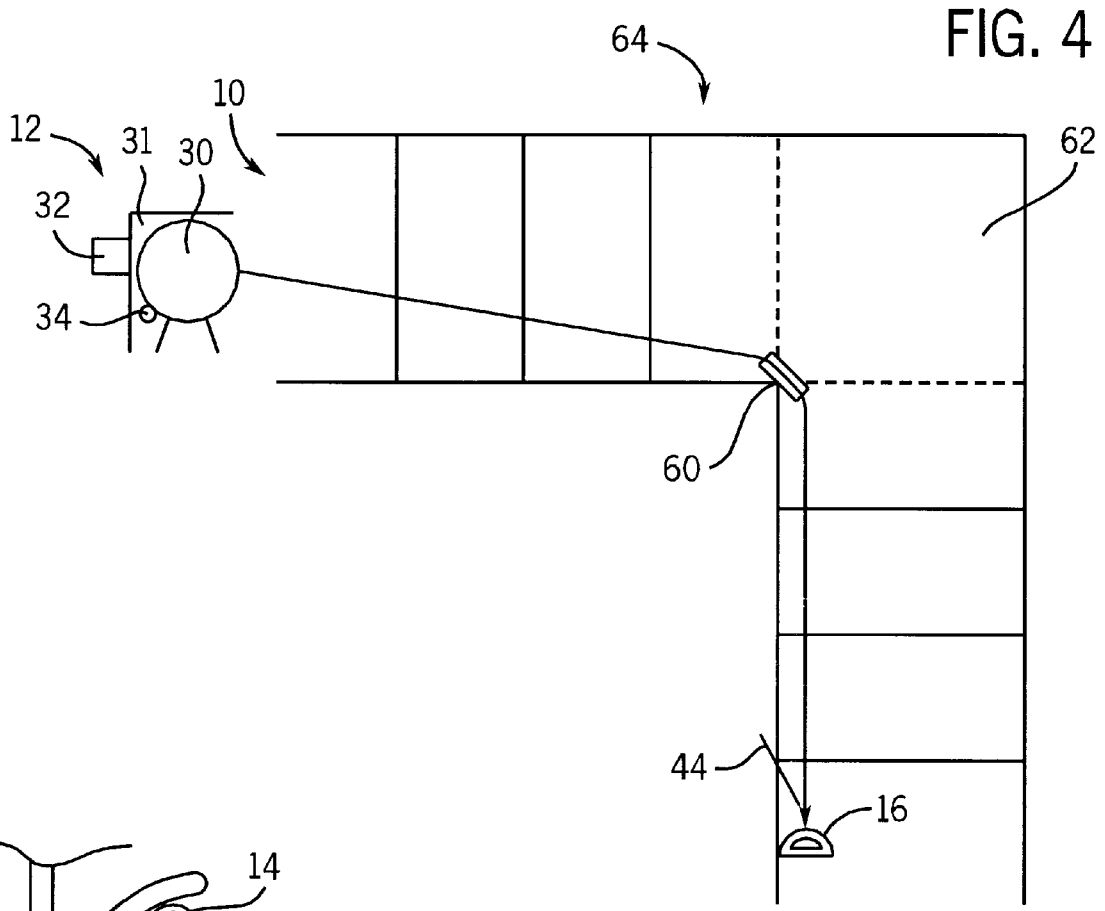
FIG. 4 is a top plan view of a preferred embodiment of the stair tow device as used on a non-linear staircase.
Figure 5A:
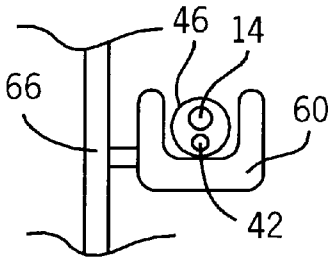
FIG. 5*a* is a perspective sectional view of the channel guide of FIG. 4 mounted in an upright position.
Figure 5B:
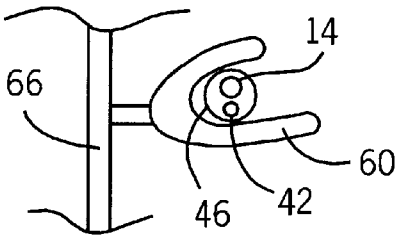
FIG. 5*b* is a perspective sectional view of the channel guide of FIG. 4 mounted in a side position.

In an alternate embodiment of the present invention, stair tow device 10 assists a person to walk up a non-linear stairway. FIG. 4 depicts one type of non-linear stairway, an angled stairway. Other types of non-linear stairways may include curved stairways or spiral stairways. Stair tow 10 operates in essentially the same manner on angled staircase 64 as on staircase 18 except that sheath 46 encasing winch cable 14 and control wire 42 runs through a suitable cable guide such as a channel guide 60 until person 36 reaches stairway landing 62. At this point, person 36 stops the operation of winch 12, removes sheath 46 from channel guide 60 and continues to walk up the last portion of angled staircase 64 assisted by stair tow 10 as previously described. Channel guide 60 directs sheath 46 around the corner of angled stairway 64. Channel guide 60 also prevents sheath 46 from damaging stairway wall 66 while stair tow 10 is in operation. Channel guide 60 may be mounted on stairway wall 66 in an upright position, as shown in FIG. 5*a,* or in a side position, as shown in FIG. 5b.

Figure 6:
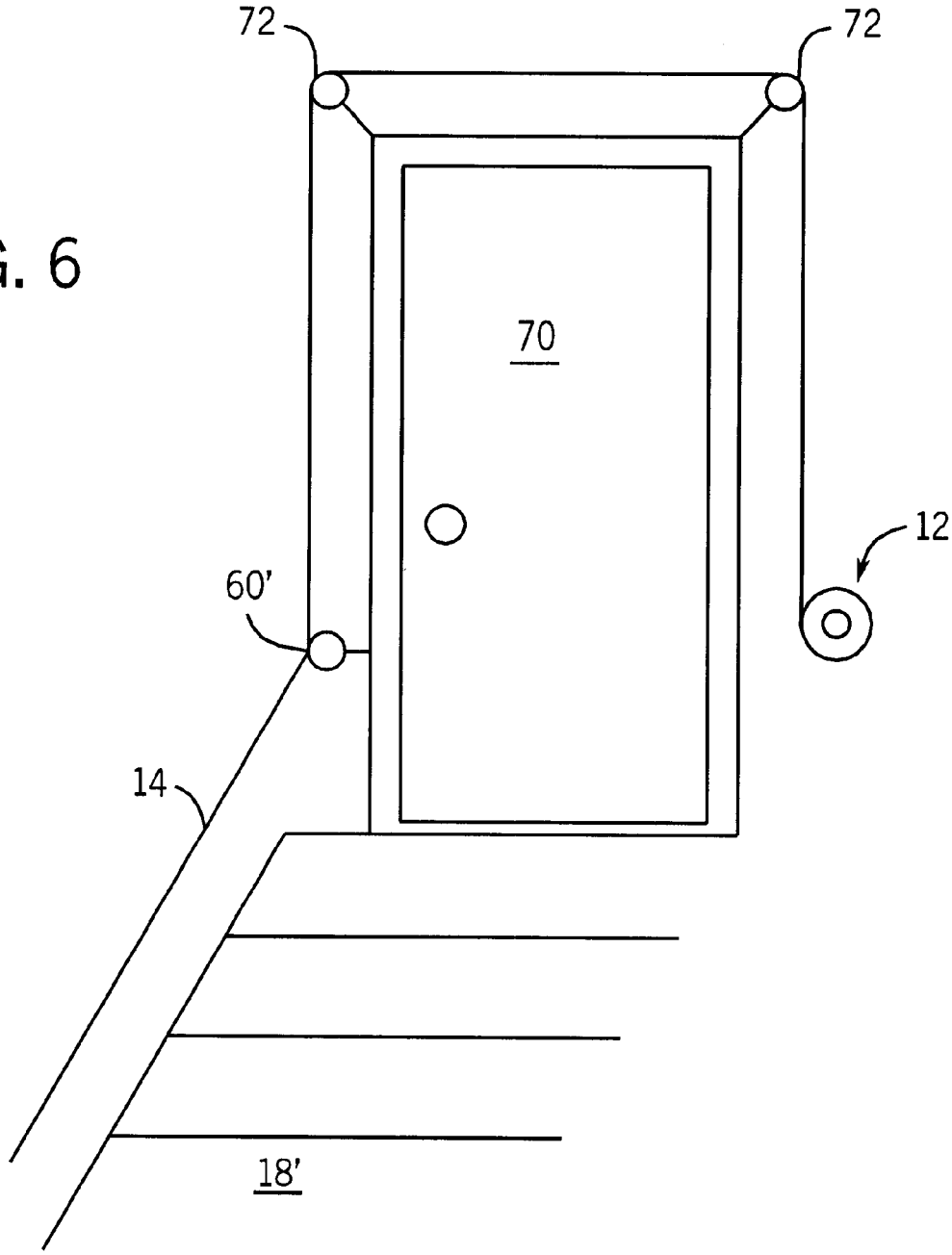
FIG. 6 is an elevation view of an alternate embodiment of the invention illustrating the use of pulleys and guides to route the winch cable.

Another embodiment of the invention is illustrated in FIG. 6. As illustrated, winch 12 is mounted at the top of a stairway 18', with a door 70 located between stairway 18' and winch 12. Winch cable 14 is guided up and around door 70 by a series of pulleys 72 around which winch cable 14 traverses and a channel guide 60', which in this case is an eye through which winch cable 14 has been threaded. In this manner, winch cable 14 is able to pass around door 70 and traverse stairway 18' . Other obstacles can be similarly avoided as desired. If utilized, the cable sensor in winch control 32 is set to be activated before winch controller 16 reaches channel guide 60'. Winch controller 16 can be hung on a hook (not shown) at the top and/or bottom of the stairs when not in use.

While the invention has been described with respect to certain preferred embodiments, as will be appreciated by those skilled in the art, it is to be understood that the invention is capable of numerous changes, modifications and rearrangements and such changes, modifications and rearrangements are intended to be covered by the following claims.

What is claimed is:

1. A stairway structure having a stair climbing assist device to assist a person in walking up the stairs, comprising:

a stairway comprising a plurality of stairs;

a winch mounted at the top of the stairway;

a length of winch cable that is at least substantially as long as the length of said stairway along which walking assistance is to be provided, said winch cable having opposing ends, one winch cable end attached to said winch;

a winch controller attached to the other winch cable end, said winch controller operatively connected to said winch for selectively causing said winch to operate, said winch controller adapted for gripping by the hand of a user.

2. The device of claim 1 wherein said winch controller is operatively connected to said winch by an electrical conductor.

3. The device of claim 2 wherein the electrical conductor is the cable.

4. The device of claim 2 wherein the electrical conductor is a wire associated with the cable.

5. The device of claim 1 wherein said winch controller is operatively connected to said winch through a radiofrequency communication device.

6. The device of claim 1 wherein the winch controller has a switch operable by the hand of a user grasping the winch controller for selectively causing said winch to operate.

7. The device of claim 6 wherein said switch comprises a button, said button being operable by the thumb of the user's hand grasping the winch controller.

8. The device of claim 1 further comprising a rotation sensor that stops operation of said winch if said winch fails to rotate for a predetermined length of time after activation.

9. The device of claim 8 wherein the predetermined length of time is from about 1 to about 3 seconds.

10. The device of claim 1 further comprising a cable distance sensor which stops the operation of said winch when said winch controller comes within a predetermined distance of said winch.

11. The device of claim 10 wherein said predetermined distance is in the range of from about 1 foot to about 4 feet.

12. The device of claim 1 wherein said winch provides a lifting force of between about 30 pounds to about 300 pounds.

13. The device of claim 1 wherein said winch controller is operatively connected to said winch by an electrical conductor.

14. A stairway structure having a stair climbing assist device to assist a person in walking up the stairs, comprising:

a stairway comprising a plurality of stairs;

a winch mounted at the top of said stairway;

a length of cable that is at least substantially as long as the length of said stairway along which walking assistance is to be provided, said cable having opposing ends, one cable end attached to said winch;

a winch controller attached to the other cable end, said winch controller operatively connected to said winch for selectively causing said winch to operate, said winch controller further comprising a handgrip.

15. The device of claim 14 wherein said winch controller is operatively connected to said winch by a radiofrequency communication device.

16. The device of claim 14 wherein the winch controller has a switch operable by the hand of a user grasping the winch controller for selectively causing said winch to operate.

17. The device of claim 14 further comprising a cable guide to permit the cable to traverse a non-linear stairway.

18. A method of assisting a person in walking up a stairway comprising:

providing a device including a winch mounted at the top of said stairway, a length of cable that is at least substantially as long as the length of said stairway along which walking assistance is to be provided, said cable having opposing ends, one cable end attached to said winch, and a winch controller handgrip attached to the other cable end, said winch controller operatively connected to said winch for selectively causing said winch to operate;

the person who will be assisted by the device, while located towards the bottom of the length of the stairway over which assistance is to be provided, grasping the winch controller handgrip;

the person actuating the winch through the winch controller handgrip to provide a force in the upward direction of the stairway while continuing to grasp the winch controller handgrip; and the person walking up the stairs while continuing to grasp the winch controller handgrip assisted by a pulling force in the upward direction of the stairway exerted on the handgrip by operation of said winch.

* * * * *

UNITED STATES PATENT AND TRADEMARK OFFICE

CERTIFICATE OF CORRECTION

PATENT NO. : 6,439,544 B1
DATED : August 27, 2002
INVENTOR(S) : Conrad Rosenberg It is certified that error appears in the above-identified patent and that said Letters Patent is hereby corrected as shown below:

Column 3,
Line 13, delete the comma after "portion" and delete "Is" and insert therefor -- is --.

Column 5,
Line 30, after "both" insert -- thumb button switch 54 and finger button switch 56. In this configuration, winch --.

Signed and Sealed this

Tenth Day of December, 2002

JAMES E. ROGAN
*Director of the United States Patent and Trademark Office*